United States Patent [19]

Johnson

[11] Patent Number: 5,064,191

[45] Date of Patent: Nov. 12, 1991

[54] GRAVITY FORCE REBOUND EXERCISER

[76] Inventor: William S. Johnson, 37203 SE. Gibson Rd., Washougal, Wash. 98671

[21] Appl. No.: 544,916

[22] Filed: Jun. 28, 1990

[51] Int. Cl.[5] ..... A63B 21/06

[52] U.S. Cl. ..... 272/117; 272/65; 272/129; 272/142

[58] Field of Search ..... 272/62, 65, 117, 113, 272/129, 130, 134, 135, 136, 142

[56] References Cited

U.S. PATENT DOCUMENTS

| | | | |
|---|---|---|---|
| 3,306,611 | 2/1967 | Gaul | 272/118 |
| 4,111,414 | 9/1978 | Roberts | 272/118 X |
| 4,199,139 | 4/1980 | Mahnke et al. | 272/118 |
| 4,741,530 | 5/1988 | Wolf | 272/134 |
| 4,988,095 | 1/1991 | Ferrari | 272/117 X |
| 4,989,861 | 2/1991 | Halpern | 272/117 X |

*Primary Examiner*—Robert Bahr

*Attorney, Agent, or Firm*—Frank D. Gilliam

[57] ABSTRACT

A static rebound exerciser/rehabilitation device for exercising a person regardless of that persons physical condition. The device includes a jack for vertically positioning a boom interconnected through a translatable cable, spring and hook to a person for elevating that person to an exercisable position. When the person to be exercised is in an exercisable position the cable is caused to oscillate the person vertically up and down against a counterbalance weight system. The amount of lift provided to the person being exercised as well as the frequency of the up and down movement is adjustable in a plurality of discrete amounts.

9 Claims, 1 Drawing Sheet

GRAVITY FORCE REBOUND EXERCISER

BACKGROUND OF THE INVENTION

The invention is directed to a therapeutic exercise/-rehabilitation device and particularly to a rebound exercise device for exercising persons regardless of their physical condition by prolonged positive and negative gravity stressing.

It is generally excepted that the human body, its components, and functions are stressed, stimulated and thereby strengthened in all activities involving resistance to the extent gravitational pull or force. The human body does not physiologically discern between the forces of inertia, acceleration, deceleration and gravitational pull.

When humans run, jump, participate in active sports or in any way move in resistance to the force of gravity, the body, its organs and cells are stressed and strengthening is induced. Body fluid circulation and waste functions are also simulated and benefited. Many people are, however, either disinclined or due to physical impairment or pain cannot participate in the above referenced activity and as a result their bodies and components and functions deteriorate and fail.

The instant invention is directed to those people that require assistance in gravity force activity for maintaining healthy bodies and body components and that force is applied through mechanical apparatus without the assistance of the person being exercised.

A prior art search uncovered various exercise devices which are taught by U.S. Pat. Nos. 4,111,414; 4,341,380; 4,586,510; 4,505,475; 4,603,855; 4,610,449; 4,720,097; and 4,846,458.

The following Patents teach harnesses for supporting exercisers while performing specific types of exercises U.S. Pat. Nos. 3,937,461; 4,431,184; and 4,410,175.

U.S. Pat. No. 4,341,380 teaches a therapeutic exercise device comprising a base resting on a floor surface and a platform located above the base and maintained rigidly parallel to the base in a horizontal through up and down cycles of the platform. A patient to be exercised stands on the platform while the platform is caused to oscillate up and down relative to the base by means of springs or motor a driven reciprocal drive which is fixed in its up and down swing distance and oscillation frequency.

U.S. Pat. No. 4,586,510 teaches the selective exercising of body parts of a paralyzed human by electrical stimulation.

There has been a long felt need for an exercising device that simulates the natural exercise encountered by normal and healthy people in their everyday activities and recreation sports. The instant invention provides a solution to that long felt need.

SUMMARY OF THE INVENTION

The invention is directed to a static rebound exerciser with a base platform for positioning the device and a vertical upright member fixedly attached thereto with a boom pivotly attached to the distal end of the vertical upright. A second vertical upright member which is shorter than the other vertical member is likewise attached to the base platform. The distal end of the second shorter vertical upright member supports a jack the support base of the jack is pivotally attached thereto along one edge thereof. The translatable member of the jack is pivotly attached to the boom intermediate its ends. The elevated position of the translatable member of the jack determines the relative angles between the longer upright member and the boom and the shorter vertical member and the jack. As the jack translatable member is translated the relative angles change. In the manner a person attached indirectly to the boom will be raised and lowered by jacking action of the jack. Attached to the boom through a series of pulleys is a cable which is attached to a spring at its distal person supporting end and is attached at its other end to a selected amount of counterbalance weight. Intermediate the ends the cable and rotatably attached thereto is a motorized oscillation mechanism which inversely raises and lowers the person supporting end of the cable and the counterbalance weight at the other end of the cable, i.e. when one raises the other is lowered. The amount of counterbalance weight is selected to substantially equal the weight of the person being exercised by the device. The oscillation mechanism is selectively adjustable through a plurality of discrete positions for adjusting the oscillation speed and the amount of raise and fall of the human attachment end of the cable through a maximum distance of from 2–8 inches in the preferred embodiment of the invention and the oscillation speed in this embodiment is from 80 to 140 cycles per minute.

An object of this invention is to provide a gravity force exerciser for humans which are physical unable to exercise in a normal natural manner due to some infirmity.

Another object of this invention is to provide a gravity force exerciser which can be selectively elevated to exercise persons of various heights.

Another object of this invention is top provide a gravity force exerciser which can be selectively adjusted to accommodate humans of different weights.

Another object of this invention is to provide a gravity force exerciser which the distance of overall vertical up and down movement can be selectively adjusted through different discrete lengths.

Yet another object of this invention is to provide a gravity force exerciser in which the oscillation frequency can be selectively adjusted through a range of discrete frequencies.

These and other objects and advantages of the present invention will become apparent to those skilled in the art after considering the following detailed specification in which the preferred embodiment are described in conjunction with the accompanying drawing Figures.

BRIEF DESCRIPTION OF THE DRAWING FIGURES

FIG. 1 is a side elevation showing of the gravity force exerciser of the present invention and FIG. 2 is a detail showing of the adjustment mechanism for the amount of the rise and fall of the person being exercised.

DETAILED DESCRIPTION OF THE PREFERRED EMBODIMENT

Figure 1:
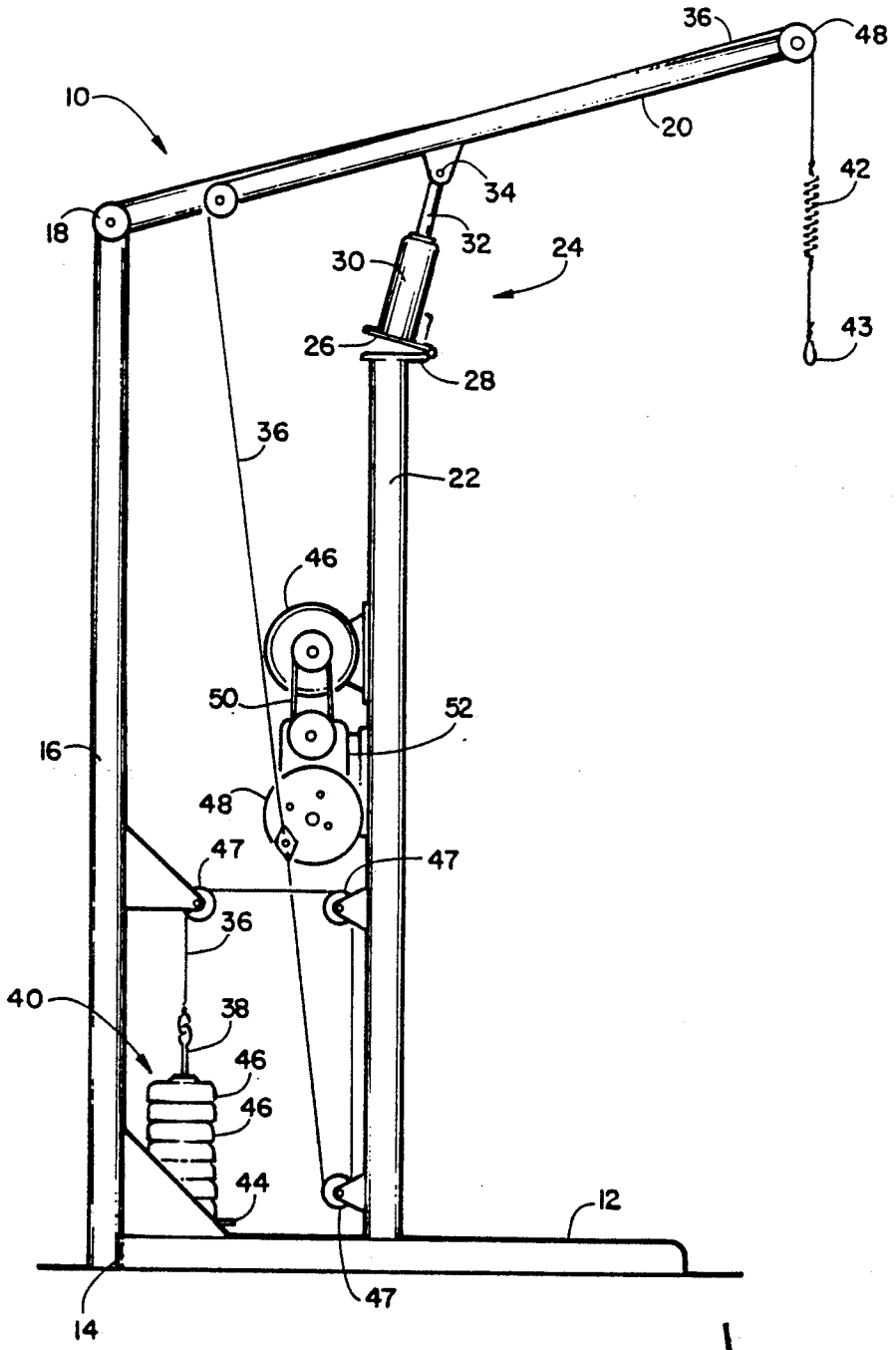
Figure 2:
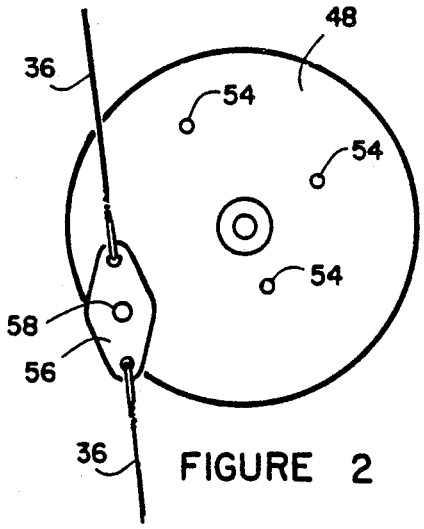

Referring now to drawing FIG. 1 which depicts a side elevation showing of the gravity exercising device 10. A horizontal base 12 supports the device 10 by resting the base on a suitable supporting surface. Attached to one end surface 14 of the base is an upright member 16. Pivotly attached to the distal end 18 of the upright member 16 is a boom 20. A vertical member 22 of a length shorter than the upright member 16 is likewise attached to the horizontal base 12 and is positioned intermediate the upright member and the opposite end of the horizontal base. A jack 24 is pivotly attached along an edge 26 to an edge 28 of the vertical member 22. The jack includes a base 30 and a translatable portion 32 which when the jack is operated in a conventional manner translates in and out relative to the base 24. The translatable portion 32 is pivotally attached at its distal end 34 to the boom 20 intermediate the ends of the boom.

A cable 36 extends from a vertical rod 38 of a conventional removal weight platform 40 to a spring 42 on the opposite end. The weight platform comprises a flat weight support surface 44 and the vertical rod 38 attached at one end to the flat weight support surface accept conventional edge to center slotted disk weights 46 for positioning on the weight support 42 around rod 38. A series of pulleys 48, five shown, support and guide the cable between the end of the rod 38 to the spring 42 and provide a minimum of friction for cable travel.

A hook member 44 or any suitable attachment member is attached the distal end of the spring 42. A suitable human body harness such as those described in the above referenced patents U.S. Pat. Nos. 3,937,461; 4,431,184; and 4,410,175 can be attached to the hook 44 to support a person.

Referring now to drawing FIGS. 1 and 3, which depict a motor 46 which drives a rotating disk 48 by means of a drive belt 50. The motor speed can be varied electrically by means of rheostat, not shown, or by a selectable ratio transmission 52. On the surface of the disk and located at different distances from the center of the disk are a plurality of attachment apertures 54. The cable 36 is spliced in the vicinity of the disk and the ends of the cable at the splice are pivotly attached to a bushing member 56. The bushing member has an aperture 58 between its ends. A pin or bolt passing partially through the aperture 58 and secured to one of the apertures 54 secures the bushing member to the disk in a rotationable relationship with the disk. It should be readily understood that the various apertures 54 provide different lengths of travel to the cable 36 when the disk is rotated by the motor, i.e. the closer the aperture 54 to the center of the disk the shorter the distance of travel of the cable.

In operation the boom is lowered to a position where a person in a support harness, not shown, can be attached to the hook 44. The boom is then elevated by means of the jack so that the person can be elevated sufficiently above the support surface to be oscillated up and down by the device. A selected one of the apertures 54 has been chosen depending on the degree of raise and fall of the person is desired. A disk speed is chosen for the desired frequency of the rise and fall of the person. Weights are added or removed so the total weight of the weights substantially equals he weight of that person to be exercised. As the person is elevated the weight support 40 tends to return toward the base 12 by gravity and when the person is lowered the weight support rises to counterbalance the weight of the person. The spring 42 allows the person to slightly oscillate relative to the operation of the disk rotation and rise and fall created thereby and absorbs shock at the end of the cable at the change from rise to fall and vice versa.

While there have been shown and described preferred embodiments of the gravity force rebound exerciser in accordance with the invention, it will be appreciated that many changes and modifications may be made therein without, however, departing from the essential spirit thereof.

What is claimed is:

1. A gravity force rebound exerciser comprising:

a cable means for supporting a person at one end and a counterbalance weight at the other end;

a cable support means for supporting said cable between ends, said support means being selectively elevatable at the person supporting end of said cable for selectively elevating a person attached to said cable, said cable support means comprises a base support member for resting on a support surface, a first vertical member fixedly attached to said base member and extending vertically therefrom, a boom pivotally attached to the distal end of said first vertical member, a second vertical member shorter in length than said first vertical member attached to said base member spaced from said first vertical member, an extendible member pivotly attached along one edge of said second vertical member and pivotly attached at its opposite end to said boom intermediated the ends of said boom whereby when said translatable member is translated said boom is pivoted about its pivotal attachment to said first vertical member; and means for periodically translating said cable back and forth relative to said cable support whereby when said cable translates in a first direction a person attached to the person supporting end of the cable is elevated and said weight is lowered and when said cable translates in a second opposite direction said person is lowered and said weight are elevated.

2. The invention as defined in claim 1 wherein the weight of said person at one end of said cable is substantially equal to said counterbalance weight at the other end of said cable.

3. The invention as defined in claim 1 wherein said counterbalance weight is selectively adjustable.

4. The invention as defined in claim 1 wherein the period for said means for periodically translating said cable back and forth is adjustable.

5. The invention as defined in claim 4 wherein said period is adjustable through a plurality of discrete frequencies.

6. The invention as defined in claim 1 wherein the length of said back and forth translation is adjustable.

7. The invention as defined in claim 6 wherein said length is adjustable through a plurality of discrete lengths.

8. The invention as defined in claim 1 further comprising a shock absorbing means positioned between said cable end for supporting a person and a person supported thereby.

9. The invention as defined in claim 8 wherein said shock absorbing means is a coil spring.

* * * * *